United States Patent [19]

Bethay, Jr.

[11] 4,293,518

[45] Oct. 6, 1981

[54] CONTROL OF SYNTHETIC YARNS DURING DRAWING WITH HEATED ROLLS

[75] Inventor: Willis D. Bethay, Jr., Camden, S.C.

[73] Assignee: E. I. Du Pont de Nemours and Company, Wilmington, Del.

[21] Appl. No.: 174,254

[22] Filed: Jul. 31, 1980

[51] Int. Cl.[3] ..... D01D 5/12

[52] U.S. Cl. ..... 264/210.2; 28/240; 264/210.8; 264/290.7

[58] Field of Search ..... 28/240; 264/210.8, 210.2, 264/290.7

[56] References Cited

U.S. PATENT DOCUMENTS

| | | | |
|---|---|---|---|
| 3,752,457 | 2/1973 | Parmeggiani | 264/210.2 |
| 3,854,177 | 12/1974 | Breen | 28/257 |
| 3,971,202 | 7/1976 | Windley | 57/205 |

*Primary Examiner*—Jay H. Woo

[57] ABSTRACT

The uniformity of bulked continuous filament yarns is improved by stabilizing the yarn path on draw pins and on heated draw rolls in a coupled spin-draw-bulk process wherein just before the yarn contacts a draw pin it is passed between two parallel guide pins in tandem in a zig-zag path which cause the plane of the yarn ribbon to rotate about the yarn axis by an angle of from 50° to 90° and back before contacting a draw pin. More uniform spreading of the yarn filaments on the heated rolls saves energy by permitting the use of lower roll temperatures.

3 Claims, 4 Drawing Figures

CONTROL OF SYNTHETIC YARNS DURING DRAWING WITH HEATED ROLLS

DESCRIPTION

1. Technical Field

This invention concerns an improved process for controlling yarn behavior during orientation drawing of synthetic continuous multifilament yarns with draw pins followed by heated draw rolls. The invention is particularly applicable for improving the quality of bulked continuous filament carpet yarns made by a coupled spin-draw-bulking process.

2. Background Art

During the spinning and drawing of synthetic continuous filament yarns, the path of a yarn needs to be guided and controlled to prevent undue wandering and to insure proper contact with critical apparatus surfaces such as draw pins and heated draw rolls. Undue wandering of the yarn on such surfaces causes nonuniformities among and along filaments which can result in an unacceptable product.

Control against wandering of a yarn across the surface of an element in the apparatus becomes particularly critical when several yarns are being processed side-by-side simultaneously over the same surface. Such side-by-side yarns must be carefully controlled to avoid transfer or filaments from one yarn to another thus affecting quality or denier standards. On the other hand when multiple yarns are being processed side-by-side, it is desirable that they be maintained as close to one another as possible in order to conserve space and to make maximum use of the equipment.

Filaments within a multifilament yarn bundle tend to spread into a flat ribbon-like configuration when passing over and between surfaces of parallel pins and/or rolls. The use of vertical guide pins to separate such yarns tend to compact the filaments at the edge of the ribbon into a narrower array as the yarn path wanders and contacts such guides with varying force. This change in configuration of the ribbon-like arrangement can cause nonuniform drawing on draw pins and nonuniform heat transfer on heated rolls.

Preferably for best uniformity filaments in multifilament yarn bundles should be spread out as evenly as possible on the surface of draw pins during drawing so that each filament is subjected to substantially the same friction and thus the same draw pattern for all filaments in the yarn bundle. Also, uniform ribbon filament arrays in a stable position are desired when yarns are running over hot rolls so that each filament is heated uniformly and consistently in substantially the same manner. For example, yarn wandering changes the heat load on the surface of such rolls. Variations in temperature history of different yarns as well as different filaments in a yarn can create unacceptable nonuniformities in the yarn.

U.S. Pat. No. 3,971,202 (Windley) depicts and describes a coupled spin-draw-bulk process for making bulked continuous filament yarns wherein a yarn is drawn between a pair of feed rolls and a pair of heated draw rolls. Between the pairs of rolls the yarn is drawn with the aid of two pairs of stationary parallel draw pins. The pair of draw rolls is heated for the purpose of preheating the drawn yarns in preparation for being bulked with a hot fluid jet device. Acceptable control of multiple side-by-side yarns on such an apparatus can usually be maintained on the draw rolls by the conventional use of parallel vertical guide pins (splitter pins) separating the yarns and located between the last draw pin and the heated draw rolls. These pins serve primarily to control the spacing between the yarns as they approach the surface of the first draw roll. Yarns prepared in such a manner, although sufficiently uniform for many carpet applications, have been found not to be sufficiently uniform to be readily accepted in certain critical solid-shade carpet styles which heretofore have been dominated by more uniform staple yarns.

Objects of this invention include a process for further improving yarn bulk uniformity, structure dye uniformity and product yield in the manufacture of bulked continuous multifilament carpet yarns and also reduced energy consumption for such manufacturing.

DISCLOSURE OF THE INVENTION

This invention is an improvement in a coupled spin-draw-bulking process for making a synthetic bulked continuous multifilament yarn in which process the yarn is melt-spun, a finish composition applied to the solidified filaments and then the yarn is drawn in frictional contact with one or more draw pins which are located between and in substantially parallel relationship to a feed roll and a pair of heated draw rolls on which the drawn yarn is preheated in preparation for bulking, wherein the improvement comprises stabilizing the path of the yarn on the one or more draw pins and on the heated draw rolls by passing the yarn, just before it contacts the one or more draw pins, between two fixed substantially parallel guide pins in tandem in a zig-zag path such that each pin creates a change of direction break angle in the yarn path of from 0° (i.e., tangential contact) to 14° while maintaining the yarn in substantially ribbon form, with the axes of the pins being oriented with respect to the yarn path between the feed roll and the one or more draw pins to cause the plane of the yarn ribbon to rotate about the yarn axis by an angle of from 50° to 90° with respect to the plane of the ribbon as it leaves the feed roll surface and as it first contacts a draw pin and then forwarding the yarn ribbon to the heated draw rolls from the last draw pin without further contact with any guiding surface.

The yarn preferably makes a break angle of from 7° to 14° with each of the tandem guide pins. Also, control against wandering of the yarn on the feed roll surface is preferably provided by a frictional guide which creates added tension on the yarn as it approaches the feed roll.

Figure 1:
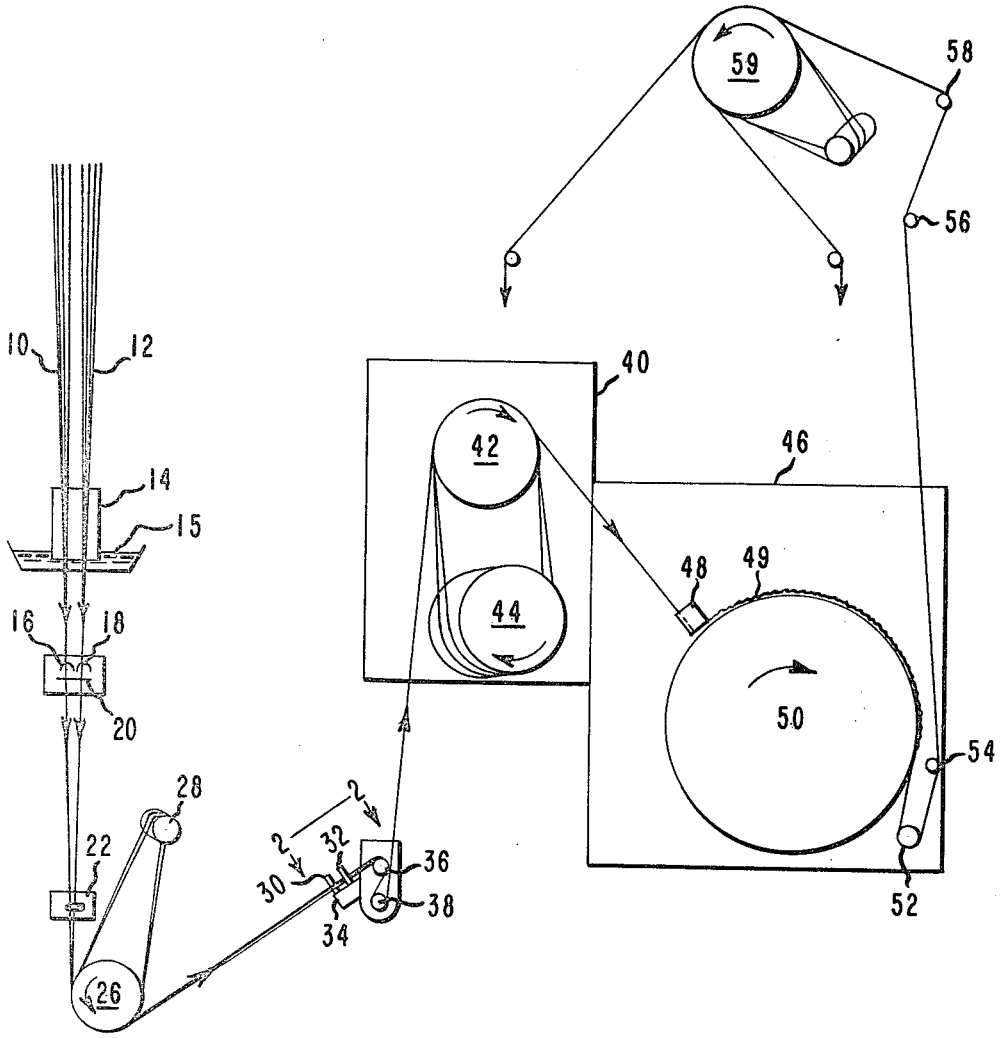
FIG. 1 is a schematic representation of a coupled spinning and drawing apparatus and process of the invention.

Referring to FIG. 1, two groups of filaments 10, 12 coming from a spinneret (not shown) contact rotating finish roll 14 where a textile finish composition 15 is applied. The filaments are converged into two separate compact bundles by U-shaped guides 16, 18 respectively. The converged filaments are subjected to a slight added snubbing tension by bar guide 20. The paths of the yarns are controlled individually by pin guide 22 which separates the yarn so as to keep them apart on the surface of feed roll 26 around which they pass in multiple wraps in association with skewed separator roll 28. Bracket 34 holds cylindrical guide pins 30, 32 in fixed position in the yarn paths just before a pair of draw pins 36, 38. Yarns 10, 12 are in a ribbon-like form in a tangential plane parallel to the surface of feed roll 26 as they leave the feed roll. Between feed roll 26 and draw pin 36 the plane of the ribbon of yarn 10 is rotated 90° about the yarn axis into the plane of the contact surfaces of guide pins 30, 32, then the yarn rotates back and resumes a ribbon-like form in the tangential plane at the point of contact with the surface of draw pin 36. The ribbon of filaments of yarn 12 is turned in substantially the same manner as yarn 10 as shown by a second set of guide pins 60, 62 in FIG. 2 through 4. The yarns then proceed around draw pin 36 and second draw pin 38 and onto the surface of hot roll 42 and its associated hot roll 44 located within an insulated chest 40. The yarn paths between draw pin 38 and the surface of hot roll 42 are free of contact with guides or surfaces which might cause them to compact the yarns or restrict their lateral freedom to spread in ribbon form on the surfaces of the hot rolls. The yarns then are both advanced in multiple wraps around the pair of hot rolls 42, 44 at a speed sufficiently higher than the surface speed of feed roll 26 to accomplish the desired draw ratio. The drawn preheated (molecularly oriented) yarns are bulked in chamber 46 by duplicate hot-fluid bulking jets 48, collected in a relaxed state as bulked yarns 49 on the surface of rotating screen drum 50, and removed therefrom around guide pins 52, 54, 56, 58 by forwarding roll 59 to yarn windup devices (not shown) for packaging.

Figure 2:
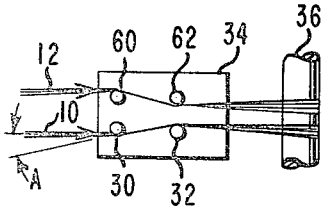
FIGS. 2, 3 and 4 are views of guide pin arrangements of the invention looking down on the tandem guide pins and draw pins as indicated by 2—2 of FIG. 1.
Figure 3:
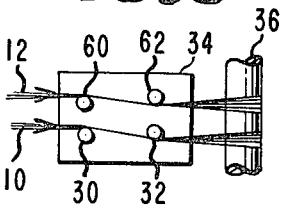

FIGS. 2 and 3 shown from direction 2-2 in FIG. 1 looking down onto bracket 34 show bracket 34 holding two pairs of guide pins 30, 32 and 60, 62 (one pair for each of yarns 10 and 12), the pins in each pair being in tandem. In FIG. 2, the yarn paths are arranged to reduce the spacing between the yarns on the surface of draw pin 36 as compared to the space between them upon approaching pins 30, 60. In FIG. 3, the yarn paths maintain the same spacing of the yarns before and after the pairs of pins.

Figure 4:
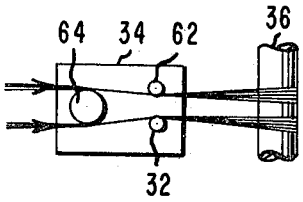

The arrangement of FIG. 4 accomplishes the same result as in FIG. 2 merely by replacing pins 30 and 60 with a single larger diameter pin 64.

As represented by angle A in FIG. 2, adequate control of the yarn can be established with an angle of break in the yarn path direction at each of the pins in a pair (30,32) of as little as 0°, i.e., tangential contact with each of the two guides. However, with such little contact, any wandering of the yarn at all axially on the surface of feed roll 26 can cause the yarn to lose contact with the first guide at times resulting in inadequate control. Such wandering on the feed roll can be reduced by using a bar guide 20 (as in FIG. 1) to slightly increase tension on yarns ahead of the feed roll. Preferably break angles of from about 7° to 14° on each of the pins in tandem provide adequate control to prevent any unavoidable wandering of yarn on a feed roll from affecting the yarns while on the draw pins.

While the axes of the tandem pins 30, 32 are shown herein to be substantially perpendicular to the yarn path between feed roll 26 and draw pin 36 the angle may be anywhere within the range of from about 40° to perpendicular, i.e., 90°.

Because of drawing of the filaments at the draw pin, the cross sectional dimensions of the filaments leaving the draw pins are smaller than those of the undrawn filaments approaching the pins. Because of the drawing action the drawn filaments tend to become spread to a still wider ribbon-like pattern as they leave the surface of draw pins 38 and approach hot roll 42. Because of the greater stability of the yarn paths on draw pins 36, 38 provided by tandem pins of the invention, the yarn paths maintain precise positions on the surface of the hot rolls without significant wandering providing greater assurance that the filaments will have equal heat treatment on the hot rolls.

Guide pins suitable for use in this invention may be constructed of metallic or ceramic materials commonly used for such yarn guides, with ceramic pins being preferred for greater durability and better spreading of the filaments into a ribbon form. Steel pins having a diameter of 3/16 inch are suitable, as are ceramic pins having a diameter of $\frac{3}{8}$ inch. With reference to FIG. 3 using ceramic pins with a $\frac{3}{8}$ inch diameter, the pins may have a center-to-center distance in the direction of yarn travel of 15/16 inch with the centers being offset laterally by a distance of 9/32 inch.

Referring to FIG. 4 and using ceramic pins, good results can be obtained with pins 32 and 62 having a $\frac{3}{8}$ inch diameter and pin 64 having a $\frac{1}{2}$ inch diameter, with the centers of pins 32 and 62 being spaced 0.875 inch apart and at a distance along the yarn path from the center of pin 64 of 0.750 inch. These distances and dimensions can be adjusted as necessary by one skilled in the art according to yarn denier, filament count and other apparatus dimensions to obtain the required break angles with yarn paths and yarn control as needed.

This invention in conjunction with a coupled spin-draw-bulking process of the type described in U.S. Pat. No. 3,854,177 (Breen et al.) operating under commercial conditions is found to improve bulk uniformity, dye uniformity, and product yield of first grade product. For example, the standard deviation (sigma) based on threadline-to-threadline comparisons of conventional bundle crimp elongation of a 1520 denier carpet yarn is reduced from 1.95 to 1.39 with the invention as represented in FIG. 1. Also, because of the improved uniformity of heating of the individual filaments on the hot roll achieved by the invention, it is found that draw roll temperatures can be reduced by about 5° C. because of better heating with this invention. This lower temperature results in energy savings.

I claim:

1. An improved coupled spin-draw-bulking process for making a synthetic bulked continuous multifilament yarn in which process the yarn is melt-spun, and then drawn in frictional contact with one or more draw pins which are located between and are substantially parallel to a feed roll and a pair of heated draw rolls on which the drawn yarn is preheated in preparation for bulking, wherein the improvement comprises stabilizing the path of the yarn on the one or more draw pins and on the heated draw rolls by passing the yarn just before it contacts the one or more draw pins, between two fixed substantially parallel guide pins in tandem in a zig-zag path such that each pin creates a change of direction break angle in the yarn path of from about 0° to 14° while maintaining the yarn in substantially ribbon form, with the axes of the pins being oriented with respect to the yarn path between the feed roll and the one or more draw pins so as to cause the plane of the yarn ribbon to rotate about the yarn axis by an angle of from about 50° to 90° with respect to the plane of the ribbon as it leaves the feed roll surface and as it first contacts a draw pin, and then forwarding the yarn to the heated draw rolls from the last draw pin without further contact with any guiding surface.

2. A process of claim 1 wherein the yarn makes a change of direction of from about 7° to 14° with each of the two tandem guide pins.

3. A process of claim 1 or 2 wherein tension on the yarn approaching the feed roll is increased by frictional contact with a snubbing yarn guide.

* * * * *